US006075868A

United States Patent [19]

Goldfarb et al.

[11] Patent Number: 6,075,868

[45] Date of Patent: Jun. 13, 2000

[54] APPARATUS FOR THE CREATION OF A DESIRABLE ACOUSTICAL VIRTUAL REALITY

[75] Inventors: Barry S. Goldfarb, Deland; Darren P. Ryle, Deltona, both of Fla.; Gary McGinnis, Powell; Josh Dickman, Knoxville, both of Tenn.

[73] Assignee: BSG Laboratories, Inc., Deland, Fla.

[21] Appl. No.: 08/986,712

[22] Filed: Dec. 8, 1997

Related U.S. Application Data

[63] Continuation-in-part of application No. 08/426,822, Apr. 21, 1995, Pat. No. 5,764,777.

[51] Int. Cl.[7] ..... H04R 5/00

[52] U.S. Cl. ..... 381/301; 381/333; 381/388

[58] Field of Search ..... 381/335, 388, 381/396, 301, 300, 333, 334, 332

[56] References Cited

U.S. PATENT DOCUMENTS

| | | | |
|---|---|---|---|
| 3,393,766 | 7/1968 | Mitchell . | |
| 4,015,778 | 4/1977 | Chen et al. . | |
| 4,023,566 | 5/1977 | Martinmaas | 381/388 |
| 4,354,067 | 10/1982 | Yamada et al. | 381/396 |
| 4,450,495 | 5/1984 | Naruki . | |
| 4,602,358 | 7/1986 | Sadan . | |
| 4,654,907 | 4/1987 | Haugaard . | |
| 4,746,166 | 5/1988 | Sadan . | |
| 4,758,047 | 7/1988 | Hennington . | |
| 4,944,019 | 7/1990 | Watanabe | 381/335 |
| 5,147,109 | 9/1992 | Jolly . | |
| 5,177,616 | 1/1993 | Riday . | |
| 5,179,447 | 1/1993 | Lain . | |
| 5,390,246 | 2/1995 | Gay et al. . | |
| 5,398,992 | 3/1995 | Daniels . | |

FOREIGN PATENT DOCUMENTS 4-354-906 12/1992 Japan .

OTHER PUBLICATIONS

Interactive Speaker Designer, "Common Designer", v.0.03 (C) 1997, Juha Hartikainen.

*Primary Examiner*—Vivian Chang
*Attorney, Agent, or Firm*—Quarles & Brady

[57] ABSTRACT

A portable collapsible seat with an advanced five-driver integral audio system is disclosed. The seat is designed to be used in conjunction with a video screen to create an enhanced "virtual reality" environment. The placement of the drivers relative to the user's head, combined with the intentionally different bandwidths of sound produced by the different drivers, and the relative acoustical intensities of the drivers produces psychologically "gripping" effect, designed to transport the user away from the reality of the actual surroundings and into the virtual reality of the video presentation. One of the drivers is intentionally oriented and positioned to provide tactilly perceivable vibration through the seat to the user.

26 Claims, 8 Drawing Sheets

APPARATUS FOR THE CREATION OF A DESIRABLE ACOUSTICAL VIRTUAL REALITY

CROSS-REFERENCE TO RELATED APPLICATION

This is a continuation-in-part of U.S. patent application Ser. No. 08/426,822, filed Apr. 21, 1995, now U.S. Pat. No. 5,764,777.

FIELD OF THE INVENTION

The invention relates generally audio-visual virtual reality systems, and to video games and to arcade video games where the player is seated in a seat attached to the game while playing, and more specifically to sound systems used with video games, virtual reality apparatus, and personal video stations.

BACKGROUND OF THE INVENTION

Over the last decade, video games have been a popular form of entertainment for consumers. As the computation necessary to generate advanced full-motion graphics has steadily become cheaper, and algorithms for generating imagery on the fly have become more well developed, the average consumer has continued to make regular expenditures of discretionary income to upgrade home video game systems, and play the latest arcade video games. One of the draws of arcade video games and advanced home video games is the level to which the realism of the images enables the player to escape from the real world for a time and enter the fantasy world of the game. The graphics of top arcade games have gone from simple two-dimensional representations, to three dimensional representations with complex shading and textures, and the laws of physics well represented in how the three-dimensional characters and objects in the games interact.

As the video images produced by top video games have taken staggering leaps forward in complexity over the last ten years, the sound tracks of these games have also advanced considerably, though not as much as the video images have advanced. This is partly due, perhaps, to the lack of significant advancement in the designs of the speaker systems that deliver the sound to the consumer who is playing the game. Most speaker systems in arcade video games remain quite similar to those of 10 years ago. These are either simple monaural speaker systems, or simple stereo speaker systems, usually mounted in the cabinet of the video game console, which is usually positioned in front of the consumer playing the game.

As the sound tracks for these video games improve, they are getting closer to the level of quality found in the sound tracks of today's box office hit movies. These movies often contain amazing special effects. A sound track which creates an acoustic experience which "grips" the audience can be a key factor in transporting the audience into the artificial reality being created by the movie. In this vein, top-of-the-line video games will be using sound more and more to create the reality for the player of the game. As this trend continues, it is likely that audio systems for video games are likely to continue to improve in quality. Let's take a look at the nature of the "quality" that home audio system designers have striven for over recent decades.

The reproduction of music, with desirable psycho-acoustical characteristics (such as might be experienced in a concert hall listening to a live performance) has been the objective of many in the audio industry for years. The modern pursuit of this goal has included implementations utilizing digital signal processing for the reconstruction of a sound field by measuring the acoustic response of the field and then modifying the input to an array of loudspeakers to produce the appropriate velocity and pressure within the fluid medium.

Some hold that audio systems should be designed for the "exact" reproduction of a sound field that might be experienced by a listener in a concert hall. The exact reproduction of a sound field can be approached one of two ways. In the first way, a recording of the sound experience to be reproduced may be made on a binaural recording device which mimics the size and shape of a human head (including the ears). When played back through headphones, such a recording can be strikingly lifelike, with much of the spatial (directional) cues preserved. The disadvantage of this type of recording is that it is so highly optimized for headphone play-back; it does not sound as good as a "regular" stereo recording when played back through speakers which aren't right next to the listener's head. Another disadvantage of headphones is that their use may be cumbersome or impractical in some applications, and headphones used in public applications (such as in CD stores or arcades) are prone to reliability problems.

The second way that one can approach the reproduction of a sound field is to produce a sound field with multiple speakers placed at different points in space, and fed different signals (hereinafter referred to as a "multi-channel" audio system). Stereo is the simplest such commonly employed approach. Such psycho-acoustic parameters as perceived "depth", "spaciality", "color", and "timbre" are generally agreed to be much improved in a stereo sound system, as compared with a monaural sound system. Driver characteristics such as linearity and frequency response also affect the perceived quality of the signal.

Sound systems with more than two speakers also exist (though they are not as widely used as simple stereo). Such systems include Dolby Surround-Sound (used in theaters), and earlier attempts at "quadraphonic" standards. The problem in designing multiple-speaker systems beyond simple stereo is choosing a trade-off in the number of transducers, the placement of those transducers, the design of those transducers, and the signals fed to those transducers to economically produce a "desirable" psycho-acoustical effect.

Trying to recreate a standard audio bandwidth (20 Hz–20 kHz) sound field to arbitrary accuracy throughout a room is a totally impractical problem. As detailed in a publication by Nelson, P. A., 1994, "Active control of acoustic fields and the reproduction of sound," *Journal of Sound and Vibration,* 177(4), pp. 447–477, to identically reproduce a sound field with an array of transducers over a frequency range extending from 20 Hz to 10 kHz and for a sphere of 10 m diameter would require over 1 million individual sources.

Fortunately, the human auditory system is not measuring "everything" about the sound field. Some is known about what "key" things contribute to perceptions (perceptions such as "this sounds 'real', and this doesn't"), and a lot is still not known. An exciting opportunity exists in the field of audio to discover and design systems which, while much simpler than the above described one million transducers, provide highly desirable psycho-acoustical effects at reasonable prices, and are thus valued by consumers.

One cost-saving innovation which has become quite widespread in modern stereo systems is the addition of a third "subwoofer" transducer to the original stereo model. The sub-woofer produces low-frequency sounds, usually below about 250 Hz. The human auditory system is not good at determining the source direction of such low-frequency sounds. Thus one transducer may be used as effectively as two, an the sub-woofer transducer may be placed anywhere in the room. In typical musical selections, these low frequencies account for most of the power that a loudspeaker set requires. They also account for most of the distance of cone-motion in loudspeakers. By removing the low frequencies from the stereo speakers, cone motion, and its associated nonlinearities (which cause distortion) are reduced. All these factors together allow the stereo speakers (in a system utilizing a subwoofer) to be manufactured in smaller, less obtrusive enclosures, with cheaper components, for less cost. The consumer gets a higher quality, more aesthetically pleasing system, for less money.

Within stereo systems (with or without sub-woofers), the mid and high frequencies are often produced by separate transducers in the same cabinet (so-called "midrange" drivers and "tweeters"). While often not necessary from a distortion perspective, the splitting of mid and upper-range frequencies between two transducers is often desirable from the standpoint of obtaining a flat frequency response. Mid-range drivers often have numerous high frequency resonances, at which the amplitude of sound produced changes drastically. This produces a sound of less desirable quality. Another problem with mid-range drivers at high frequencies is that they typically produce widely varying sound intensities in different directions, thus, depending on where the listener is in the room (worse yet, if the listener is moving in the room) the listener may hear inconsistent or annoying quality variations from the speakers.

In the past ten years, signal processing, and in particular, digital signal processing has allowed for the most significant breakthroughs in the quest for more psycho-acoustically pleasing sound reproduction. The quest for "accurate" reproduction of sound is ironic in some ways. Many have been assuming the need to accurately reproduce something, yet concert halls with the same (accurate, live, "real") sources in them have vastly different perceived qualities, even with no distortion. Taking this into account, one could hold that an ideal audio system could create new realities (or acoustic environments), not just reproduce known ones. Some of today's digital signal processing units have taken a cut at creating part of the reality (as the concert hall does). Digital signal processing audio units cannot, however, overcome some of the basic physical limitations imposed by the speakers we attach to them, such as the physical positions of the speakers in the room, and their directionality (radiation patterns) at different frequencies.

We are a society undergoing a paradigm shift in our culture regarding entertainment. Today's movies and virtual reality games take us well beyond the thirst for reality in reproduction, into a thirst for things beyond what are "real", the thirst for new experiences which can be created. Musicians electronically create instruments that do not exist, which have pleasing musical characteristics. Special effects experts create entire visual worlds that do not (an indeed in some cases cannot) exist, and people pay higher and higher prices to experience these creations. Many of these creations put the observer in places where he or she cannot normally be ("in the experience", so to speak), such as standing next to a Tyrannosaurus Rex as it eats someone. The desire here is for the new, the vivid, the "more than real", but definitely not just "accurate reproduction of something previously experienced".

As the demand for the ability for us to "enter the experience" grows, a significant market will form for in-home systems which can provide this "more than real" entertainment. New acoustical sound production paradigms (not just sound reproduction, because we want to make things "more" than real) will be in demand.

It is an object of the present invention to provide an improved multi-channel audio system which, when playing today's film and video game sound tracks, provides a more involving "gripping" psycho-acoustical experience for the listener, transporting the listener more effectively into the virtual "reality" of the film or video game. It is a further object of the present invention to provide an improved multi-channel audio system which is superior to present-day stereo and other multi-channel audio systems, in such psycho-acoustical dimensions as "timbre", "color", "spatiality", and "depth". It is a further object of the present invention to provide an aesthetically pleasing, ergonomically superior multi-channel audio system. It is a further object of the invention to provide a multi-dimensional acoustical audio system that combines the selection of transducers, the placement of those transducers and the spectral separation of frequency to the transducers to optimize the psycho-acoustical effect to the user. It is a further object of the invention to provide the psycho-acoustical experience to the user with a focus on the binaural auditory system and tactile sensory system of the user and not the audio source. It is a further object of the invention to provide an easy-to-set-up, easy-to-store, portable seat for use with video games and the like, with integral sound and/or vibration which provide an enhanced virtual reality experience.

SUMMARY OF THE INVENTION

The present invention offers a quantum leap forward in the psycho-acoustical environment that can be created for the player of a video game, or "virtual reality" game. When using a system according to the invention, the user is presumed to be seated in a seat integral to the system. A common use of the system would entail setting up the apparatus as a viewing and listening station in which to sit and operate a video game or watch a video on a screen set up in front of the apparatus and the user.

According to the invention, an apparatus for creating an acoustical virtual reality in connection with an audiovisual entertainment, such as computer video games, includes a seat having a seat back and a seat base connected along a joint line and a plurality of acoustics drivers, preferably loudspeakers, at least some of said loudspeakers being positioned on said seat structure and arranged at least to the left and right of the seating area with one speaker centered forward of the seating area.

The positions of the three speakers can define a triangle wherein the line between the left and right speakers and a line between one these speakers and the third, central speaker form an angle of greater than 45 degrees.

The apparatus can further include a sub-woofer for producing signals less than 100 Hz. The subwoofer is preferably mounted in the back portion of the seat with its axis of motion transverse to the support surface for the user's back, and particularly his lower lumbar region. The subwoofer is preferably dual-ported to the sides of the seat back, proximate the height of an average user's ear level.

The apparatus can also include a high frequency device for producing signals above 16 kHz. The high frequency device is preferably placed above the left and right loudspeakers and behind the user's head. Thus, the high frequency device can be centrally placed along the top of the seat back.

The left and right loudspeakers can be mounted on wings extending from the sides of the seat base. These speakers are preferably mounted facing upwardly through apertures providing circular deflectors. The central loudspeaker can be similarly mounted upwardly near a front end of the seat base and equipped with a circular deflector.

According to another aspect of the invention, the apparatus provides a collapsible seat having at least a low frequency vibrational transducer or loudspeaker for tactile signal generation. The collapsible seat preferably is also equipped with other loudspeakers for generating a sound field as well. The seat can include an internal amplifier, and optionally, audio intensity limiters.

The seat construction preferably includes a hinged assembly including a lower extension of the seat back that serves as a carrying handle during storage and transport and a resistive support in the open position against the user's back leaning. The hinge can include a detent latch for securing the seat in both the open and the closed position. The seat housing is preferably constructed to port the subwoofer with a dual tuned port system. The lower seat base can also be designed to port the back wave of the central loudspeaker to lateral sides of the seat base.

Thus, the apparatus of the invention provides a seated environment for creating an acoustical virtual reality to enhance audio visual entertainment in connection with video games and the like. The system not only provides enhances audio but also tactile signals to the user.

DETAILED DESCRIPTION OF INVENTIVE EMBODIMENTS

The invention is directed to a device for creating an audio and tactile virtual reality environment for a user seated on the device to enhance the experience in audio-visual entertainment, such as playing a video game or viewing a motion picture.

Figure 1:
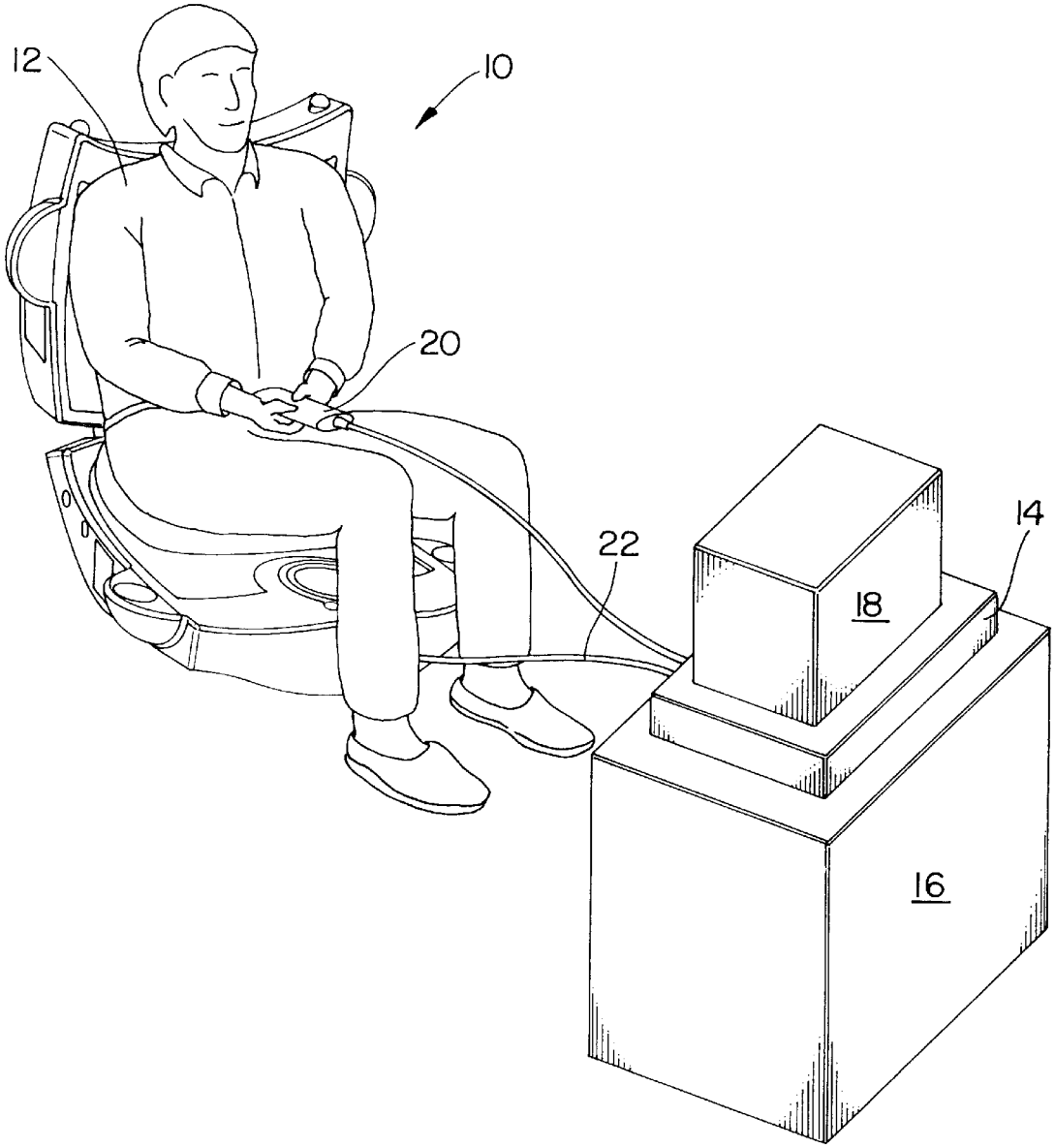
FIG. 1 is a perspective view of an embodiment of the invention in use with a computer-based video gaming system.

Referring to FIG. 1, a seating apparatus 10 according to the invention can be mounted by a user 12 for use during the playing a video game through a computer 14, on for example a stand 16, with associated viewing on a video monitor 18 or the like. The user 12 can interact with the computer 14 or video game through hand controls 20 in known manner. The apparatus 10 supplies audio and preferably tactile signals to the user 12, as discussed more fully below. The input signals from the computer can be provided through a cable 22 to the apparatus 10.

Preferred embodiments of the present invention makes use of both spatial signal processing (the placement of transducers in known spatial relationships with respect to the listener), temporal signal processing (the selection of the range of frequencies reproduced by each transducer in the system), power balancing (the selection of the relative loudness of the sounds the listener hears from each transducer), and vibrational coupling to create a multi-dimensional (the spatial dimensions, the temporal dimension, the power-balancing dimension, and the tactile dimension) acoustical audio system with desirable psycho-acoustical effects. The system has been designed to produce a sound field optimized for perception through the process by which the binaural auditory system (human hearing) processes sound, as opposed to being designed to produce a certain frequency response at a microphone placed some fixed distance on-axis from a speaker in an anechoic environment as in conventional loudspeaker performance assessment. The result is an increase in the perceived "width" and "depth" of the "sonic image" and an increased the "sweet spot" well beyond those perceived with normal stereophonic sound reproduction.

The combining of both spatial signal processing, temporal signal processing, and power balancing in the present invention provides some of the advantages available through Digital Signal Processing (DSP), and allows the realization of many psycho-acoustical effects not available through DSP.

Because the present invention is designed for perception by the binaural auditory system, it is appropriate to review this biological system here. Binaural hearing is required to physically locate stimuli in the real world. There are two basic methods by which the location of a sound source is determined by the binaural auditory system. Each is distinct and has an effective bandwidth of operation. Firstly, the interaural time difference (ITD) in the arrival of a sound wave at each respective ear can be used to determine the direction from which the sound emanated. At relatively low frequencies, below 1500 Hz, the wavelength of the sound wave is greater than the characteristic dimension between the ears (approximately 0.2 m for a typical person). Thus, a distinct time delay in the propagation of the sound wave can be resolved. While this method of resolving the direction can be effective up to 3000 Hz, it has limited accuracy between 1000 Hz and 3000 Hz as the acoustic wavelength decreases. At frequencies greater than 3000 Hz, the primary method of resolving the direction of a sound source is based upon the interaural intensity difference (IID). At higher frequencies and decreasing acoustic wavelength, sound waves are partially blocked by the effective "baffle" created by the head if the source is not positioned directly in front of the listener. Thus, variations in sound intensity presented at each ear help in discerning the location of a source at relatively high frequencies.

In reverberant, enclosed, sound fields, the sound originating from a source will bounce off the walls several times in various directions until it decays sufficiently to be inaudible. However, for transient acoustic waves, extensive testing has shown that the direction from which a sound first arrives is perceived to be the location of the source even if the reflected (delayed arriving signal) is larger than the first arriving signal (Moore, 1989).

Oddly enough, the frequency range in which directional information is difficult to discern by either ITD or IID is in a range of 1 kHz to 3 kHz where the sensitivity of the ear to sound is quite high. Accordingly, a single mono sound source placed in front of the listener with an upper frequency limit of approximately 3 kHz and will not have a dramatic effect on the perceived direction of the sound over the audible range, but can be effectively used to "create the center stage".

At higher frequencies, it is imperative to have both left and right stereo signals if stereophonic imaging is desired. In fact, based upon the IID method of detecting the position of a sound source, the optimal location of the stereophonic transducers producing sound in the approximately 900 Hz to 16 kHz bandwidth are at opposite sides of the listener to maximize the IID. At low frequencies, the acoustic wavelength is so long that a listener cannot accurately resolve the direction of the source (because the sound heard at either ear is nearly in phase), so a sub-woofer (0 to 250 Hz bandwidth) can be placed in any position relative to the user to economically reproduce the low-frequency component of the sound (which usually requires the most power and produces the most driver cone excursion). Finally, a single mono high frequency device (producing frequencies from approximately 4–6 kHz to >20 kHz) can be located near the rear of the listener or centrally overhead to achieve the effect of greater reverberation. The pinna (outer ear) serves to diminish the sound by virtue of reflection and diffraction at high frequencies when the sound wave is presented from behind. Acoustic waves reflected in a reverberant field also impinge the ear at reduced intensities than that of the original wave. Thus, placing a higher frequency driver at the rear of the listener can achieve the psycho-acoustical impact of a more "live" acoustic field as opposed to the more complex use of full-bandwidth transducers and signal processing to achieve the same desired effect.

Traditional acoustical priorities such as low distortion and adequate frequency response, together with new objectives involving psycho-acoustical qualities such as "spatiality" have been taken into account by the design of one embodiment of the multi-dimensional acoustical audio system set forth herein. Conventional audio speaker performance specifications lose meaning here because the sound system provided by this invention is designed to be perceived through the binaural auditory system, not a microphone positioned at a fixed distance from a speaker mounted in a baffle. Quality transduction devices are used in this system to minimize distortion. Within the present invention, the relative sensitivity of each transducer is not as important as is the location of each device relative to the listener, coupled with the associated temporal filtering which is unique to the position of the device relative to the listener.

In one embodiment according to the invention, the apparatus comprises a collapsible portable chair or seat with an integral audio system. While in collapsed form, all drivers and amplifiers of the audio system are internal to the unit. When in use, some components of the audio system remain internal to the chair, and some are deployed in a fixed spatial relationship to the seat (and the listener seated there).

In addition to the placement of the transducers in the system, there are certain aspects of the mounting of the transducers and the design of the individual transducer enclosures which provide key improvements in the quality of the perceived sound field. The side transducers are preferentially oriented vertically (with their radiating surfaces parallel to the horizontal plane), and their enclosures preferentially include acoustic reflectors suspended in front of the transducers, to give a more desirable acoustic dispersion pattern across the range of frequencies produced by the transducer. This circularly symmetric reflector ensures that sound emanates with equal intensity in all directions in the horizontal plane. This circularly symmetric pattern may be combined with placement of a reflecting surface on the opposite side of the side sound sources from the listener. This spreads out the apparent side sources from the point of view of the listener, because sound energy may be received from all over the reflective surface. The apparent spreading of the source can result in an improved psycho-acoustical effect.

Figure 2:
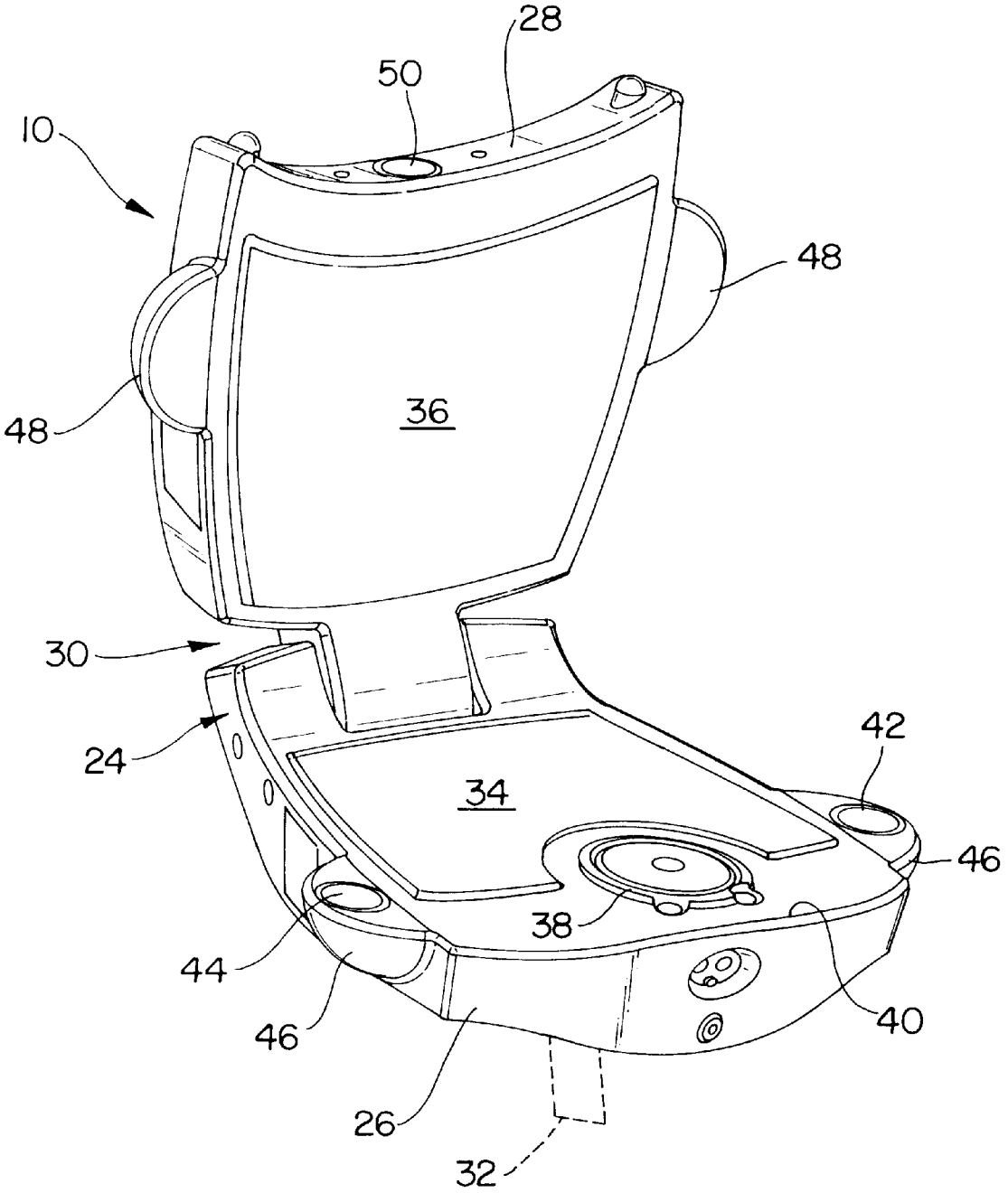
FIG. 2 is a further perspective view of the embodiment shown in FIG. 1.

Referring to FIG. 2, the apparatus 10 is preferably constructed as a portable, collapsible seat 24 with integral and attached audio components. The seat 24 includes a base 26 connected to a back 28 through a hinge assembly 30. The base 26 is constructed for placement on the floor, but can also be mounted on a pedestal 32 for raised seating more in the manner of a chair. The seating area 34 of the base 26 and the support area 36 of the seat back 28 can be equipped with cushioned surfaces, such as by foam or rubberized pads, to provide comfortable seating to a user.

The system preferentially includes at least one central audio loudspeaker 38 placed substantially in front of the user. The central audio loudspeaker 38 is preferably positioned forward of the seating area 34 near the front edge 40 of the seat base 26, facing upwardly, and may in some embodiments be placed separately from the seat 24 closer to the video screen being viewed. The central audio loudspeaker 38 preferably has an input filtered to range in frequency from substantially 150 Hz to no more than 10 kHz. In a preferred embodiment, the maximum input frequency to the central audio loudspeaker 38 is limited to 6 kHz. The central audio loudspeaker 38 can be any of a variety of loudspeakers capable of performing in the frequency range specified but is preferably selected to have an optimal sensitivity and performance in the above input range.

The embodiment for immersive observation further includes a left audio loudspeaker 42 placed directly to the listeners' left when seated, and a right audio loudspeaker 44 placed in directly to the listener's right. The left audio loudspeaker 42 and the right audio loudspeaker 44 should be spaced far enough from the listener's ears when seated so that the distance from the listener's head to each of these loudspeakers 42, 44 is large compared to the normal amount that the listener's head might move forward, backward, and from side to side during the normal playing of a video game or watching of a movie.

While it is preferred that the left audio loudspeaker 42 and the right audio loudspeaker 44 be located directly to the sides of the observer, it is within the scope of the invention that the loudspeakers may be forward or rearward of these exact positions, but preferably these speakers are symmetrically placed, at positions no more than 50 degrees off to the front or rear of an imaginary line passing through the listener's ears when seated.

The left audio loudspeaker 42 and the right audio loudspeaker 44 can each be mounted in a wing 46 formed on either side of the seat base 26. The seat back 28 can provide mating wings 48 to overlay the base wings 46 when the base 26 and back 28 are engaged in a closed position.

According to the invention, the left audio loudspeaker 42 and the right audio loudspeaker 44 each have an input preferably filtered to range in frequency from substantially 900 Hz to at least substantially 12 kHz, in order to produce the desired psycho-acoustical effect. The frequency range of the left audio loudspeaker 42 and the right audio loudspeaker 44 can extend beyond 16 kHz. The left and right audio loudspeakers 42, 44 may be constructed using of a variety of drivers capable of performing in the frequency range specified but are preferably made with drivers selected to have an optimal sensitivity and performance in the specified input range.

In combination with the left audio loudspeaker 42 and the right audio loudspeaker 44, the central audio loudspeaker 38 creates a central image with greater perceived "depth" to the sound field.

The embodiment for immersive observation preferably further comprises at least one sub-woofer audio loudspeaker (not shown in FIG. 2) having at least one low pass filtered input having an upper cutoff frequency preferably below 100 Hz. The sub-woofer audio loudspeaker may be placed anywhere, but is preferentially mounted inside the back section 28 of the seat 24.

A preferred embodiment of the immersive sound system further includes a high frequency device 50 or transducer with a frequency bandwidth extending from approximately 4–6 kHz, preferably through the upper frequency limit of human hearing (15–20 kHz). The amplifier for the high frequency device 50 may be a dedicated amplifier or part of a multichannel amplifier, and is preferably equipped to sum the two signal inputs from a typical stereo audio source to mono prior to amplification.

The high frequency device 50 is preferably mounted to the rear of the listener, near or above the level of the listener's ears, and vertically higher than the left and right audio loudspeakers 42, 44. The high frequency device 50 may be constructed using a variety of transducers capable of providing high quality sound in the specified range.

Figure 3:
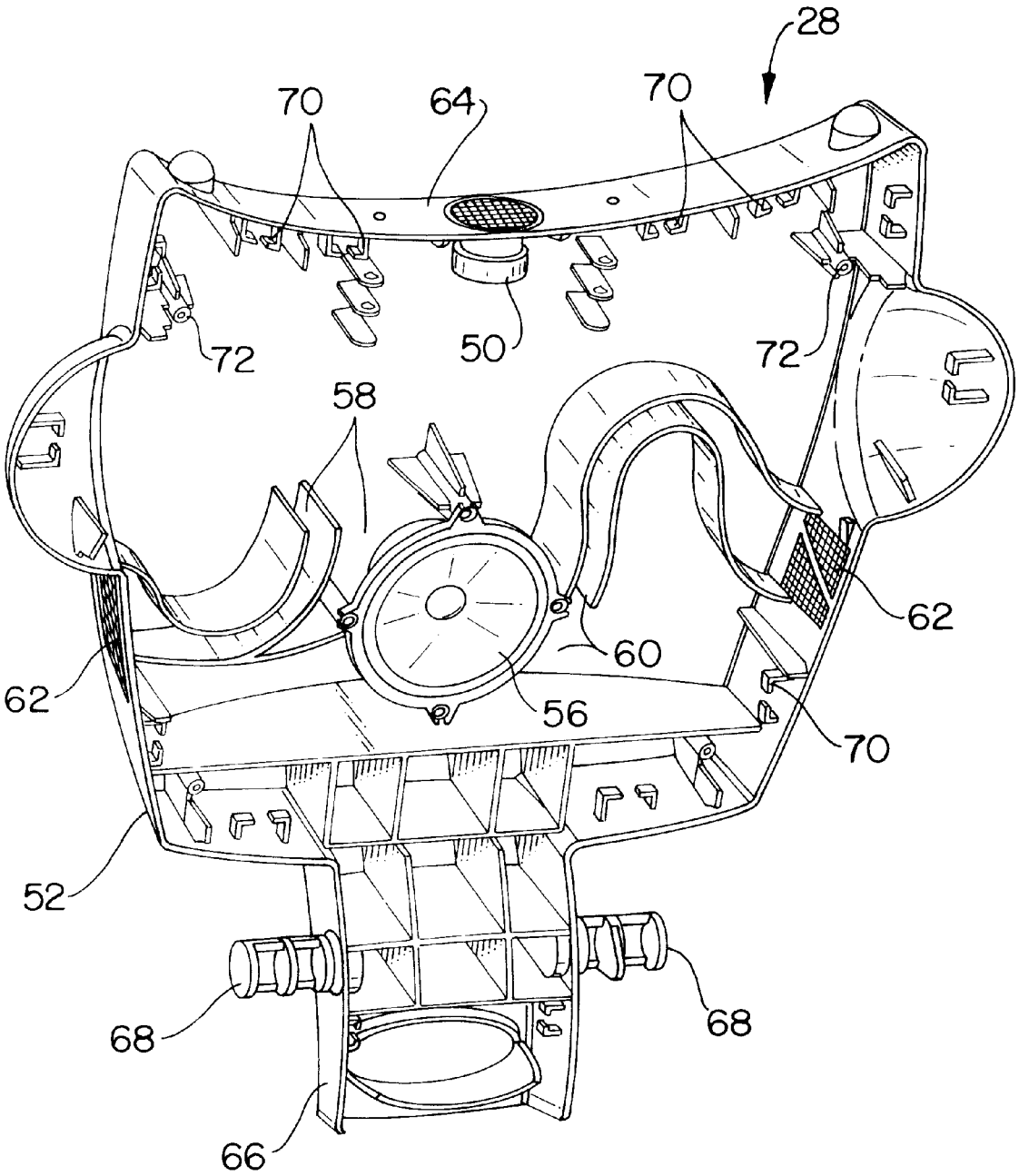
FIG. 3 is a perspective view of the rear section of a seat back of the embodiment of FIG. 2.
Figure 4:
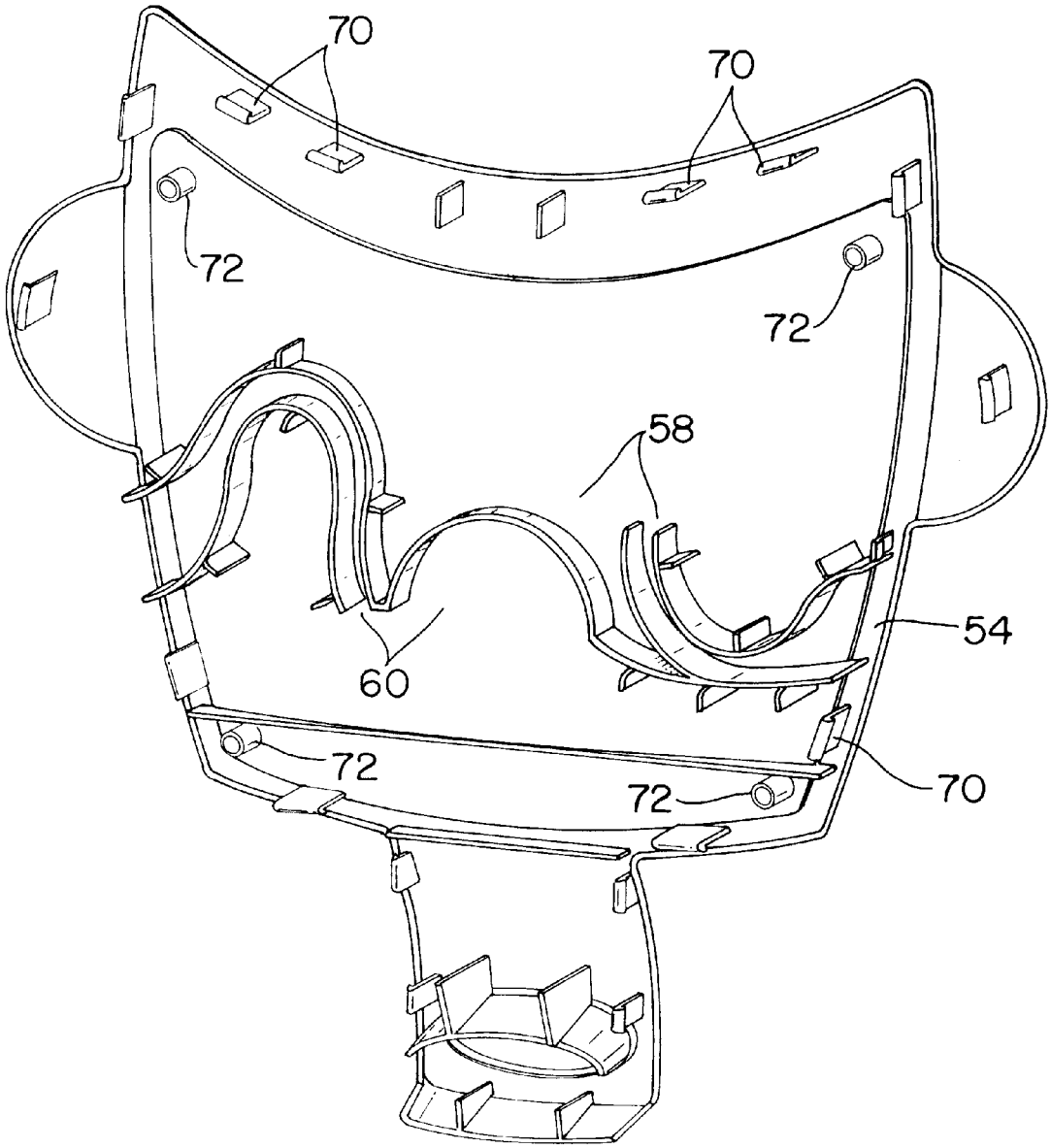
FIG. 4 is a perspective view of the front, mating section for the seat back section of FIG. 3.

Referring to FIGS. 3 and 4, the back can be constructed by the merger of a rear section 52 (FIG. 3) and a front section 54 (FIG. 4). The sub-woofer loudspeaker 56 is preferably mounted in a dual-tuned cavity design. The back side of the sub-woofer loudspeaker drives a lower-frequency tuned cavity 58, while the front side of said driver 56 drives a higher-frequency tuned cavity 60. Acoustic energy from the tuned cavities 58, 60 is ported to the outside environment for the listener through ports 62 respectively. The tuned cavities 58, 60 preferably have their resonant frequencies so aligned that the lower 3 dB point of the higher-frequency tuned cavity 60 is coincident in frequency with the upper 3 dB point of the lower-frequency tuned cavity 58.

The described positioning of the subwoofer 56 provides two advantages. First, the preferred position of the axis of motion of the subwoofer 56 transverse to the support surface 36 of the seat back 28 (FIG. 2) places tactile vibrations from the subwoofer 56 adjacent the lower lumbar region of a user seated in the apparatus. Secondly, the porting of the sub-woofer back waves along the sides of the seat back 28 produces the signal proximate the users's ears for enhanced efficiency in delivery of the bass signals.

The sub-woofer audio loudspeaker 56 can be driven by an output channel of a separate amplifier that combines the two channel input from the audio source. Alternatively, the sub-woofer audio loudspeaker 56 can be driven by one of the outputs of a multichannel amplifier that processes the two channel input from the audio source.

The high frequency loudspeaker 50 can be mounted along a top side 64 of the seat back 28 for positioning above the left and right loudspeakers 42, 44 (FIG. 2) and proximate the rear of the user's head, as discussed above.

The seat back 28 preferably includes a lower extension 66 with lateral hinge posts 68 for pivotally connecting to the seat base 26. The front and rear sections 52, 54 of the seat back 28 can be injection molded and secured together with peripheral snap mounts 70 and screw ports 72.

Figure 5:
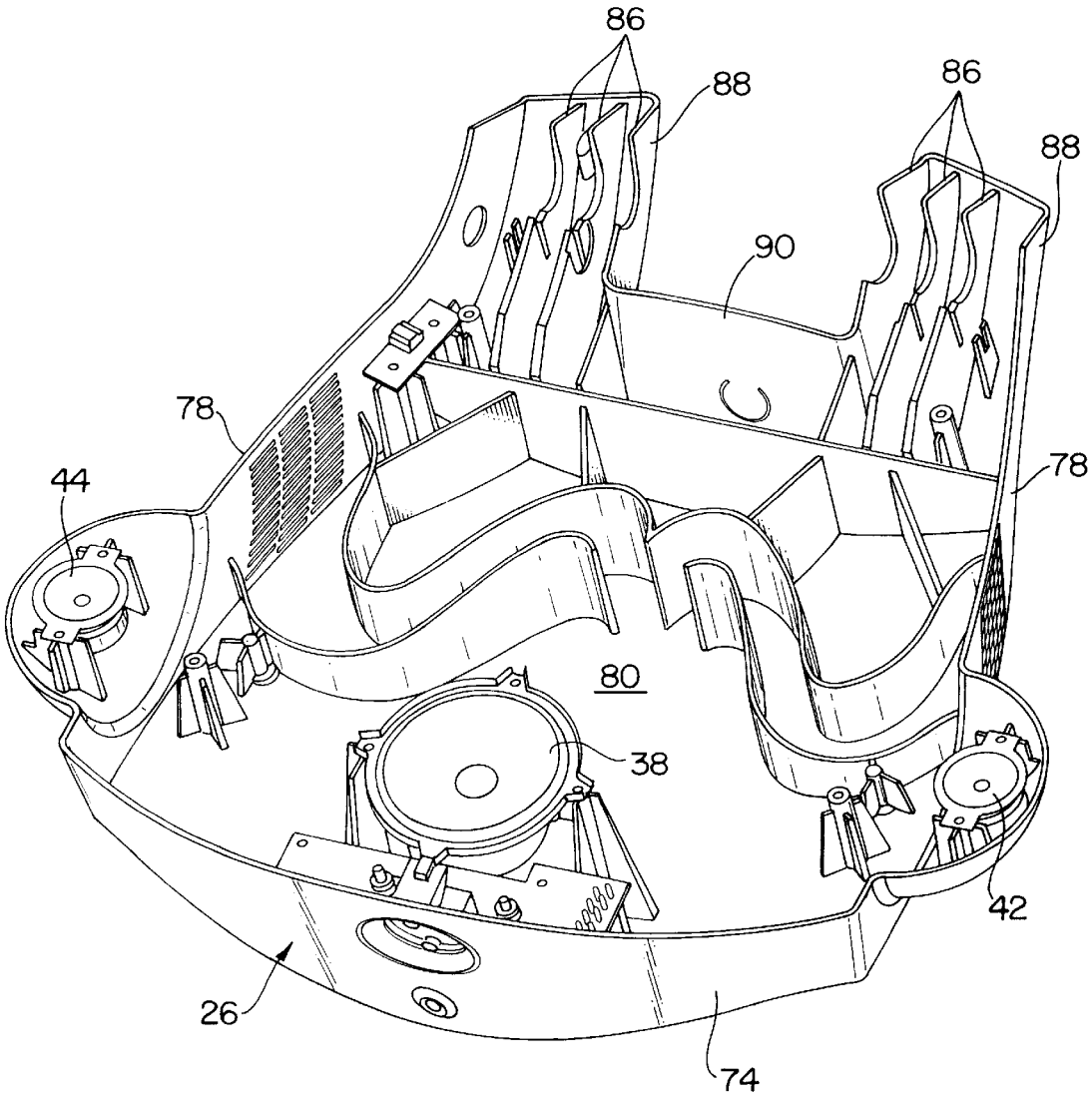
FIG. 5 is a perspective view of the lower section of a seat base of the embodiment shown in FIG. 2.
Figure 6:
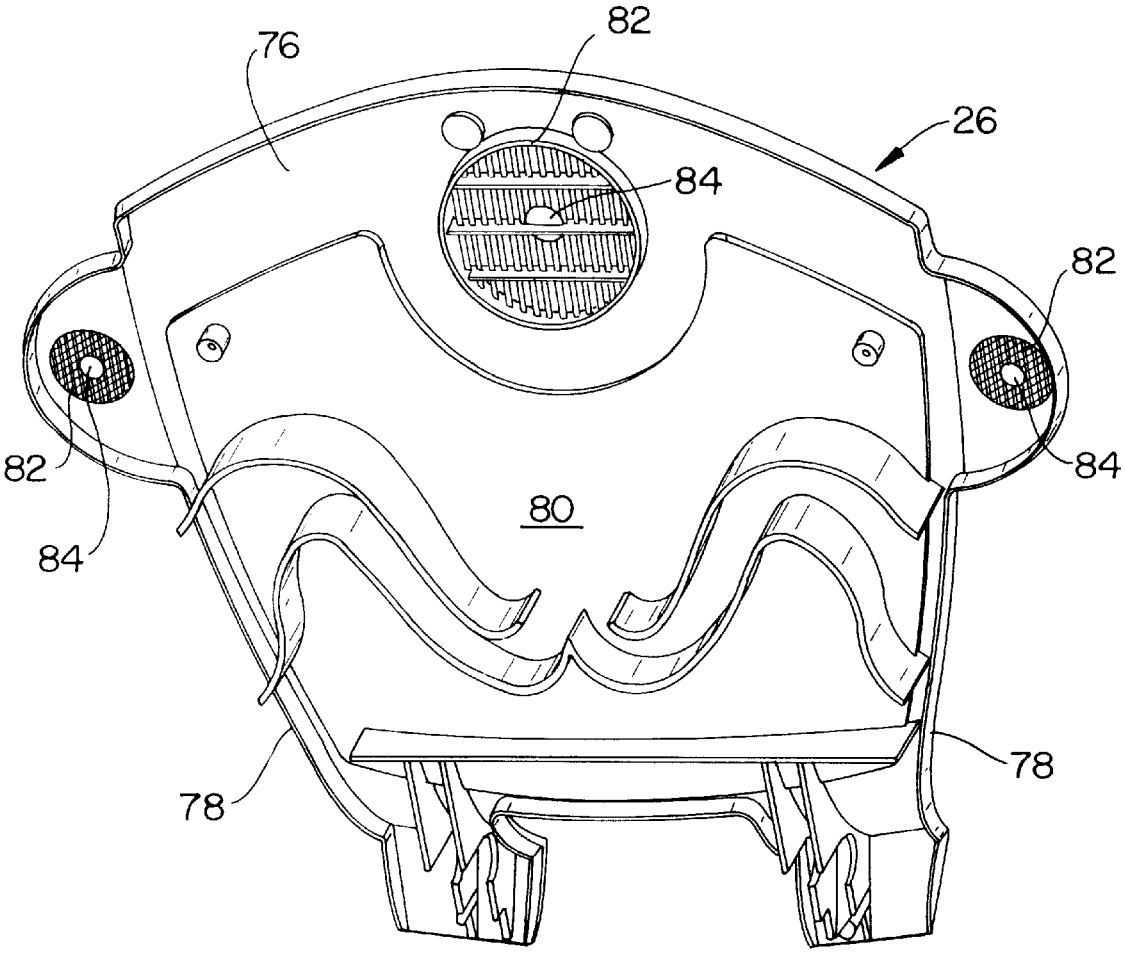
FIG. 6 is a perspective view of the upper, mating section for the seat base section of FIG. 5.

Referring to FIGS. 5 and 6 together, the seat base 26 can be formed by the merger of a lower section 74 (FIG. 5) and an upper section 76 (FIG. 6), which bears the seating area 34 (see FIG. 2). The rear waves of the central audio loudspeaker and the left and right loudspeakers can be ported to the sides 78 of the seat base through a chamber 80 defined in the seat base sections. The upper section of the seat base can provide grilled apertures 82 for the front waves of the central loudspeaker and the left and right loudspeakers.

In order increase the acoustic efficiency and further increase the homogeneity of the radiation pattern, each grilled aperture 82 can provide a circularly symmetric, preferably hemispherical acoustic reflector 84 thereby placed in front of each driver, external to the speaker enclosure 26. The circularly symmetric acoustic reflector serves two functions (in addition to being aesthetically pleasing). First, the acoustic reflector concentrates more of the sound energy at the level in the room where listener's ears are likely to be, and reduces the acoustic energy at the ceiling or floor level. This distribution increases the efficiency of the system. Second, the reflector may be shaped to reduce the vertical inhomogeneities in the sound field in the vertical region of the room where listener's ears are likely to be. As mentioned in the summary of the invention, the circularly symmetric radiation pattern of the left and right loudspeakers, may be combined with their proximity to acoustic reflectors, resulting in a diffusing effect on the localizability of the left and right loudspeakers, adding to the psycho-acoustical quality of the listening experience. Because the ear differentiates between first arrival and echoes, it is important to keep the left and right loudspeakers close to reflectors if the defusing effect is to be optimized. This is because when the speakers are close to the reflectors, the amplitude of the first echo (from the reflector next to the speaker) is so close the amplitude of the sound directly from the speaker, and the delay between the first arrival and the first echo is so short, that the human auditory system perceives the two as one (diffused) source. In many cases, this can add to realism, because many real-life sources of high-frequency sound (such as a symbol), are much larger physically (and therefore less spatially localizable by human hearing) than the tweeter of a typical loudspeaker.

The upper and lower sections of the seat base can provide a series of support ribs 86 on two rear extensions 88 for engaging and securing the hinge posts 68 of the seat back (FIGS. 3 and 4). The lower section provides, between the extensions, an abutment surface 90 for engaging the lower extension of the seat back to limit the opening pivot of the seat back to its final upright position, as shown in FIG. 2.

Figure 7:
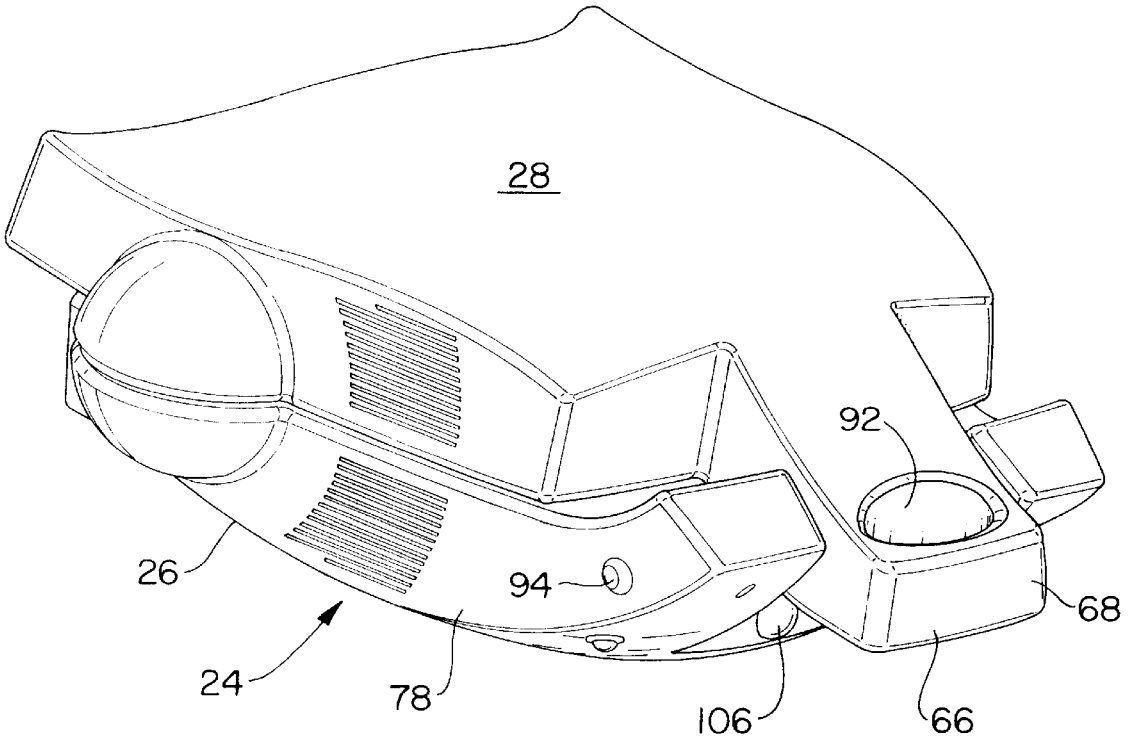
FIG. 7 is a perspective view of the embodiment shown in FIG. 2, shown in a closed configuration.

Referring to FIG. 7, the seat assembly is preferably collapsible to a closed configuration suitable for protective storage of the loudspeakers during transport. The lower extension of the seat back can provide an opening 92 to form a carrying handle. To secure the seat assembly in either the open position for use, as shown in FIGS. 1 and 2 or the collapsed, storage and transport position shown in FIG. 7, the apparatus can provide a latch mechanism actuated by push buttons 94, one on each side of the seat base.

Figure 8:
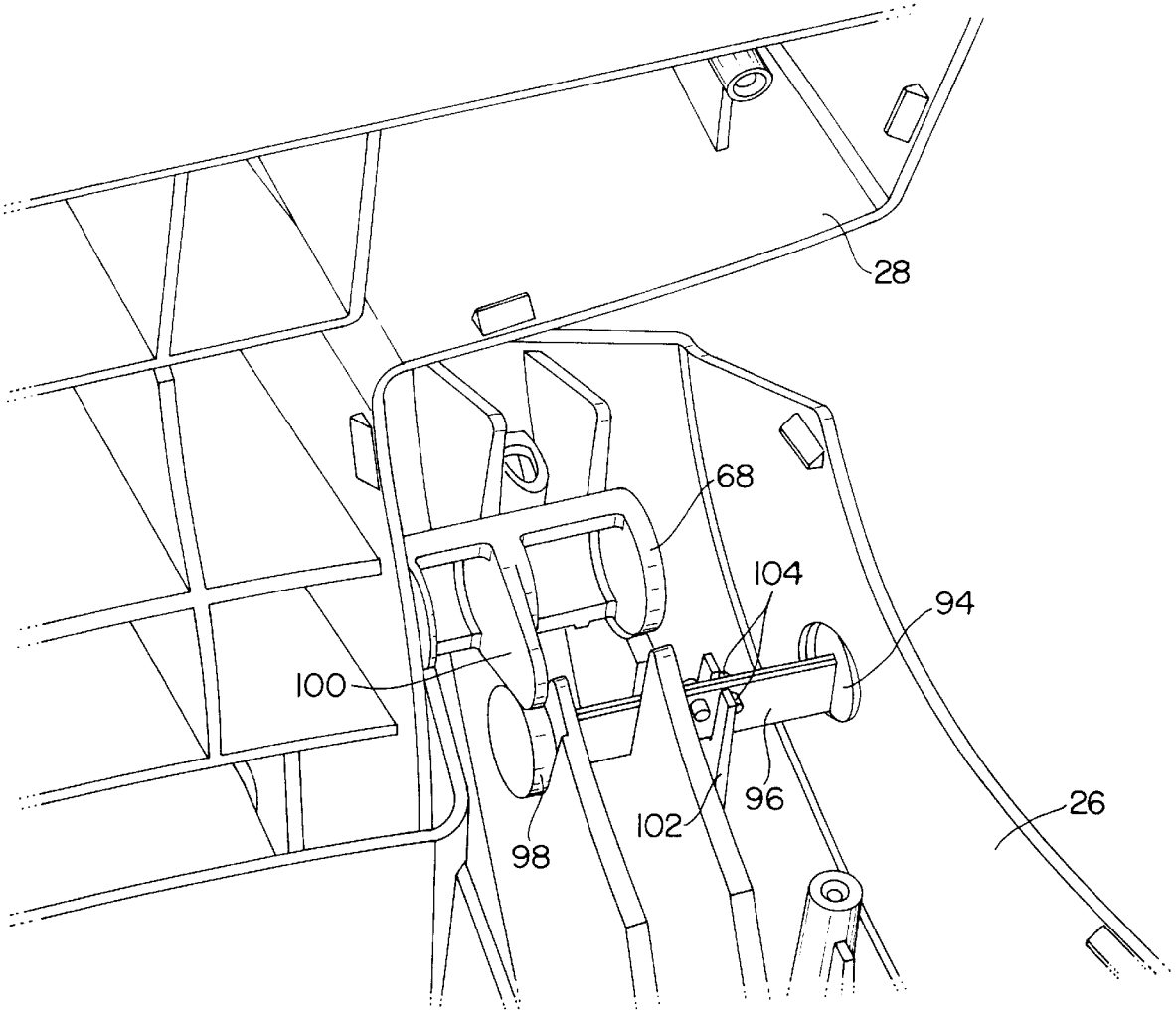
FIG. 8 is an exposed perspective view of the interface of the rear seat back section and the lower seat base section, illustrating the internal features of a hinge latch mechanism according to the invention.

Referring to FIG. 8, the button 94 can be connected to a latch bar 96 terminating in a latch head 98. The latch head can interface with a cam arm 100 on the hinge post to prevent relative rotation of the seat back and the seat base. The seat back and the seat base, illustrated in the open position are thus prevented from being closed.

The latch head and its actuating button can be urged to the latching position shown by a spring tab 102 extending from the seat base. The spring tab can be plastic molded integrally with the seat base and positioned to bias the latch bar through pins 104 to the latched position.

To release the latch head from the locked position and permit rotation of the hinge post, the button can be urged against the resistance of the spring tab. A similar assembly can exist on the opposite side of the seat base, and unlatching occurs in such a case by simultaneous depression of the latch buttons. The seat back can be biased to begin its collapse upon depression of the latch buttons by a resistive compression of a resilient pad 106 at the rear of the seat base (FIG. 7) for resistive engagement with the lower extension of the seat back.

The opposite side of the latch cam of the hinge post can also be latched by the latch head when the seat assembly is collapsed. The collapsed seat assembly can be biased to open when the latch buttons are depressed by the resistive compression of the seat pads (FIG. 2).

The audio system for providing driving signals to the loudspeakers includes an audio generating source for generating a plurality of audio signals and may be a gaming or other type computer with CD player, film soundtrack, VCR player or tape deck. The audio source is fed to signal processing electronics which can include preamplifiers and crossover networks to amplify the signal and use either active or passive crossover networks to separate the frequencies but preferably with predetermined overlaps for the different loudspeakers. The crossover network can produce two or more channels in the frequency range from substantially 20 Hz to 20 kHz for the left, right, center, rear, and sub-woofer audio loudspeakers, and an electromechanical vibration transducer, if one is used.

The signals generated by the signal processing electronics are preferably amplified by an amplifier system utilizing separate amplifiers to drive the spatially and spectrally distinct loudspeakers in the system. The amplifier system and crossover electronics may be built into the seat, or housed in a separate enclosure.

In a preferred embodiment utilizing a separate amplifier for each transducer, the amplifier system also includes transducer-specific limiter circuitry to ensure that the acoustic signals produced by each transducer are within an amplitude range considered safe for human hearing.

A headphone jack can be included to facilitate use while causing less disturbance in a surrounding area. In a preferred embodiment, plugging in headphones to the headphone jack substantially silences all but the lowest frequencies produced by the audio and vibrational transducers of the apparatus. Low-frequency signals produced by the transducers are left undiminished by the use of headphones, in order that the user may still experience the tactile portion of the virtual reality experience.

The novel positioning and geometric construction (spatial signal processing) and operating frequency bandwidth (temporal signal processing) of each loudspeaker contributes to the creation of a sound field with a greater perceived sonic width and depth than conventional loudspeaker systems and to the creation of an expanded "sweet spot" within the (enclosure) seated environment.

The electronic signals sent to central, subwoofer and high frequency drivers are preferably all mono, as opposed to stereo. The only stereo signals of the preferred embodiment are sent to left and right drivers. The left and right stereo signals sent to left and right transducers are required by the binaural auditory system to effectively "locate" or "position" the stimuli audibly.

According to the invention, the central loudspeaker positioned at "center stage" can be supplied with a mono signal between 150 Hz and 3000 Hz, which fills the listening environment with low to mid frequency sound waves without deteriorating the stereophonic image created by the left audio loudspeaker 16 and the right audio loudspeaker 17.

The optimization of the sound field through the combination of placement and frequency range selection is detailed in Applicant's U.S. Pat. No. 5,764,777, which is incorporated by reference herein.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Having described the invention, what is claimed is:

1. An apparatus for the creation of an immersive acoustic environment, comprising:

a seat having a left side and a right side, said seat including:

a seat back having a back support surface, and a seat base having a base support surface, said seat back and said seat base joining along a joint line, said seat base extending from said joint line to a front end; and, a sound system including a plurality of sound drivers, part of said sound system being integral to or attached to said seat during use, said sound system including:

a pair of said drivers connected to said seat substantially symmetrically about a sagittal plane separating said left and right sides, and a third of said drivers positioned toward said front end and substantially coincident with said sagittal plane;

whereby said sound system generates an immersive acoustic environment for a user seated in said seat by providing acoustic sources to the left and right of the seated user in the form of said pair of said drivers and an acoustic source in the form of said third of said drivers along the sagittal plane of the seat that substantially coincides with a central sagittal axis of the user.

2. The apparatus of claim 1, wherein positions of said first pair of drivers and said third driver define a triangle, such that the angle formed by a first line joining said first pair of drivers and a second line joining one of said first pair of drivers and said third driver is greater than 45 degrees, said triangle defining a plane non-coincident to said sagittal plane.

3. The apparatus of claim 2, wherein said first pair of drivers are positioned less than 12 inches forward of said joint line.

4. The apparatus of claim 2, further comprising a fourth driver connected to said seat, said third and fourth drivers having input circuitry configured to sum to mono a stereo input.

5. The apparatus of claim 4, wherein said fourth driver is a sub-woofer producing sound substantially only below 100 Hz.

6. The apparatus of claim 5, wherein said third driver is mounted on said seat adjacent said front end.

7. The apparatus of claim 6, wherein said pair of drivers have input circuitry to separate a left stereo channel to one of said pair and right stereo channel to the other of said pair.

8. The apparatus of claim 5, wherein said sub-woofer is mounted in the seat back and oriented with its axis of motion perpendicular to said back support surface.

9. The apparatus of claim 5, wherein said sub-woofer comprises a sub-woofer driver driving on it's face side a first ported acoustical resonance volume tuned to resonate at a first resonant frequency, and driving on its back side a second, ported acoustical resonance volume tuned to resonate at a second resonant frequency, where said first and second resonant frequencies are aligned relative to each other in frequency such that two of their 3 dB points approximately coincide, producing a broadened, flatter resonant response.

10. The apparatus of claim 6, further comprising a lower-frequency tuned cavity and a higher-frequency tuned cavity, each driven acoustically by opposite sides of said sub-woofer driver.

11. The apparatus of claim 1, wherein said first pair of drivers and said third driver are mounted in said seat.

12. The apparatus of claim 1, wherein said third driver is a loudspeaker for producing sound between 150 Hz and 10 kHz.

13. A foldable seat assembly with integral electromechanical transducer system for the creation of an immersive acoustic environment, comprising:

a back section including a back support surface;

a base section including a base support surface;

a hinge hinging said back section and said base section together, said back section and said base section capable of being disposed in either an open position or a closed position; and, said seat in said closed position configured to become a carrying case, a sound system including:

a pair of drivers connected to said seat substantially symmetrically about a sagittal plane separating left and right sides of said seat, and at least one electromechanical transducer mounted in one of said back section and said base section, capable of operating in or below the audio range;

whereby said sound system generates an immersive acoustic environment for a user seated in said seat by providing acoustic sources to the left and right of the seated user in the form of said pair of said drivers and a non-directional acoustic source in the form of said at least one electromechanical transducer mounted on said seat adjacent a user sitting in said seat, and whereby the assembly for creating the immersive acoustic environment can be moved in a portable configuration carryable by the user.

14. The seat assembly of claim 13, wherein said transducer comprises an electromechanical vibration transducer capable of producing vibrations tactilly perceivable by a listener seated in said seat.

15. The seat assembly of claim 14, further comprising an internal power amplifier for driving said electro-mechanical vibration transducer.

16. The seat assembly of claim 14, further comprising at least one acoustical audio transducer capable of producing sound having frequencies substantially above 100 Hz.

17. The seat assembly of claim 16, further comprising a detent mechanism capable of locking the seat in either the fully open or closed positions.

18. The seat assembly of claim 16, further comprising internal electronic power amplifier means for powering said electromechanical transducer.

19. The seat assembly of claim 16, further comprising a sub-woofer driver driving on it's face side a first ported acoustical resonance volume tuned to resonate at a first resonant frequency, and driving on its back side a second, ported acoustical resonance volume tuned to resonate at a second resonant frequency, where said first and second resonant frequencies are aligned relative to each other in frequency such that two of their 3 dB points approximately coincide, producing a broadened, flatter resonant response.

20. The seat assembly of claim 14, further comprising transducer-specific audio intensity limiter capable of limiting the acoustic intensity produced by each transducer to levels safe for human hearing.

21. The apparatus of claim 13 disposed in the closed position, wherein said base section includes a bottom end disposed opposing said hinge and said back section includes a top end disposed opposing said hinge, and wherein said bottom end and said top end are adjacent.

22. An apparatus for the creation of an acoustical virtual reality, comprising:

a seat having a seat back including a back support surface and a seat base including a base support surface, and having a left side and a right side, said seat back and said seat base joining alone a joint line, said seat base extending from said joint line to a front end; and, a sound system, part of which is integral to or attached to said seat during use;

said sound system including a plurality of sound drivers, a first pair of said drivers being connected to said seat substantially symmetrically about a sagittal plane separating said left and right sides of said seat, said first pair of drivers positioned less than 12 inches forward of said joint line;

a third of said drivers being positioned in a forward direction from said first pair of said drivers toward said front end and substantially coincident with said sagittal plane, said first pair of drivers and said third driver positioned to define a triangle, such that the angle formed by a first line joining said first pair of drivers and a second line joining one of said first pair of drivers and said third driver is greater than 45 degrees;

a fifth driver mounted to said seat back reproducing substantially only higher frequencies in the audio range above 16 kHz, the input to said driver being a substantially summed-to-mono signal, said fifth driver being placed substantially coincident with said sagittal plane.

23. An apparatus for the creation of an acoustical virtual reality, comprising:

a seat having a seat back including a back support surface and a seat base including a base support surface, and having a left side and a right side, said seat back and said seat base joining along a joint line, said seat base extending from said joint line to a front end, said seat physically reconfigurable to become a carrying case for said sound system and seat; and, a sound system, part of which is integral to or attached to said seat during use;

said sound system including a plurality of sound drivers, a pair of said drivers being connected to said seat substantially symmetrically about a sagittal plane separating said left and right sides of said seat;

a third of said drivers positioned in a forward direction from said first pair of said drivers on said seat adjacent said front end and substantially coincident with said sagittal plane.

24. An apparatus for the creation of an acoustical virtual reality, comprising:

a seat having a seat back including a back support surface and a seat base including a base support surface, and having a left side and a right side, said seat back and said seat base joining along a joint line, said seat base extending from said joint line to a front end; and, a sound system, part of which is integral to or attached to said seat during use;

said sound system including a plurality of sound drivers, a pair of said drivers being connected to said seat substantially symmetrically about a sagittal plane separating said left and right sides of said seat, said seat base has lateral sides extending between the joint line and the front end and a wing extending from each of said lateral sides, one of said pair of drivers being mounted in each wing and facing upwardly;

third of said drivers being positioned in a forward direction from said first pair of said drivers toward said front end and substantially coincident with said sagittal plane, said first pair of drivers and said third driver positioned to define a triangle, such that the angle formed by a first line joining said first pair of drivers and a second line joining one of said first pair of drivers and said third driver is greater than 45 degrees;

a fourth driver connected to said seat, said third and fourth drivers having input circuitry configured to sum to mono a stereo input, said fourth driver is a sub-woofer mounted in the seat back producing sound substantially only below 100 Hz and oriented with its axis of motion perpendicular to said back support surface.

25. An apparatus for the creation of an acoustical virtual reality, comprising:

a back section including a back support surface, and a base section including a base support surface, hinged to each other at a hinge, and a capable of being disposed in either an open position or a closed position, and at least one electromechanical transducer mounted in one of said back section and said base section, capable of operating in or below the audio range, said transducer comprises an electromechanical vibration transducer capable of producing vibrations tactilly perceivable by a listener seated in said seat;

at least one acoustical audio transducer capable of producing sound having frequencies substantially above 100 Hz; and, a carry handle, wherein said carry handle acts to oppose linear force when the seat is being carried, and acts to oppose the torque about the hinge joint caused by a listener leaning back while using the seat in the open position.

26. An apparatus for the creation of an acoustical virtual reality, comprising:

a seat having a seat back including a back support surface and a seat base including a base support surface, and having a left side and a right side, said seat back and said seat base joining along a joint line, said seat base extending from said joint line to a front end; and, a sound system, part of which is integral to or attached to said seat during use;

said sound system including a plurality of sound drivers, a pair of said drivers being connected to said seat substantially symmetrically about a sagittal plane separating said left and right sides of said seat;

a third of said drivers being positioned in a forward direction from said first pair of said drivers on said seat adjacent said front end and substantially coincident with said sagittal plane, said first pair of drivers and said third driver positioned to define a triangle, such that the angle formed by a first line joining said first pair of drivers and a second line joining one of said first pair of drivers and said third driver is greater than 45 degrees;

a fourth driver connected to said seat, said third and fourth drivers having input circuitry configured to sum to mono a stereo input, said fourth driver is a sub-woofer producing sound substantially only below 100 Hz;

a lower-frequency turned cavity and a higher-frequency tuned cavity, each driven acoustically by opposite sides of said sub-woofer, each tuned cavity comprises enclosing walls and an exit port, and one of the enclosing walls of the lower-frequency tuned cavity comprises a seat back against which the listener's back rests.

* * * * *